United States Patent [19]

Wegrzyn

[11] Patent Number: 4,540,976

[45] Date of Patent: Sep. 10, 1985

[54] CIRCUIT ARRANGEMENT FOR A BUOYANT ALARM DEVICE

[75] Inventor: Richard J. Wegrzyn, Stratford, Conn.

[73] Assignee: Remington Products, Inc., Bridgeport, Conn.

[21] Appl. No.: 437,845

[22] Filed: Oct. 29, 1982

[51] Int. Cl.[3] ..... G08B 1/08

[52] U.S. Cl. ..... 340/539; 340/573; 340/602; 340/618; 340/623; 200/84 R

[58] Field of Search ..... 340/539, 573, 602, 601, 340/603, 604, 612, 616, 618, 623, 625, 566; 455/127, 91, 67, 95, 9; 200/61.04–61.07, 84 R

[56] References Cited

U.S. PATENT DOCUMENTS

| | | | |
|---|---|---|---|
| 3,778,803 | 12/1973 | Jahn | 340/539 |
| 3,786,469 | 1/1974 | Massaro et al. | 340/539 |
| 3,810,146 | 5/1974 | Lieb | 340/573 |
| 3,953,843 | 4/1976 | Codina | 340/566 |
| 4,121,200 | 10/1978 | Colmenero | 340/539 |

*Primary Examiner*—Donnie L. Crosland

[57] ABSTRACT

An improved circuit arrangement is described which is used with a buoyant device for indicating a disturbance to the quiescent level of a body of water. The circuit arrangement includes an encoder and transmitter which are supported by the device and which are adapted for transmitting encoded information in accordance with a predetermined pulse code to a remote receiver and alarm. Transmission of the encoded signal is terminated after a predetermined interval of time. The encoder and transmitter are coupled in the circuit for enhancing the turn off of a bi-stable switching circuit.

11 Claims, 6 Drawing Figures

CIRCUIT ARRANGEMENT FOR A BUOYANT ALARM DEVICE

BACKGROUND OF THE INVENTION

1. Field of the Invention

This invention relates to buoyant alarm devices which float in a body of water and provide an indication of a disturbance to a quiescent water level. The invention relates more particularly to an improved circuit arrangment for use with such an alarm device.

2. Description of the Prior Art

A form of alarm device is known which is adapted to float in a body of water and to provide an indication of a disturbance to a quiescent level of the body of water. Such a device is particularly useful with unattended swimming pools to signal an accidental fall into the pool by a person, or, the unauthorized use of the pool. One such device includes first and second electrodes, the first of which is supported above the quiescent water level and contacts the water when the device heels as a result of water waves accompanying a disturbance to the body of water. The second electrode is normally maintained in contact with the body of water. When the device heels and the first electrode contacts the water, a circuit is closed which initiates an alarm indication.

At times it is desirable to provide an indication of the disturbance at a station which is remote to the body of water. Such an occasion arises, for example, in conjunction with the monitoring of an unattended home swimming pool when it is desirable to provide an alarm signal inside the home rather than only in the pool area. Prior arrangments have utilized a transmitting means which is supported by the buoyant device for broadcasting a radio frequency alarm signal to the remote station. These prior arrangments have energized the transmitter and broadcast a continuous radio frequency signal upon the occurence of the disturbance, and, they have alternatively energized the transmitter and broadcast an alarm signal for only a very brief interval of time, e.g. 50 ms. In the latter case, the brief signal is intended to set a latch circuit at the receiver which causes sounding of an audible alarm. However, continous broadcasting tends to rapidly deplete batteries used with the device thus necessitating frequent checking and replacement. Broadcasting a very brief signal operates to preserve battery energy but the short signal is particularly susceptible to signal loss as a result of interfering electrical noise and atmospheric conditions which can block reception of the short communication. Both of the prior arrangments are also susceptible to false alarms because of electrical noise and interfering services. Moreover, the prior arrangments have been relatively complex and costly to fabricate. It is desirable to provide a transmitter arrangment for use with a buoyant alarm device which is substantially free from the effects of interfering electrical noise and other services, which broadcasts a radio frequency signal for a period of time sufficient to assure reception and recognition at the remote location, which does not rapidly deplete battery power sources and which can be fabricated economically.

SUMMARY OF THE INVENTION

Accordingly, it is an object of this invention to provide an improved circuit arrangment for use with a buoyant alarm device which indicates a disturbance to the quiescent level of a body of water.

Another object of the invention is to provide an improved transmitting circuit arrangment.

Another object of the invention is to provide a transmitting circuit arrangment for use with said device which reduces interference with other services and false alarms.

Another object of the invention is to provide an improved transmitting circuit arrangment having means for enhancing the reliability of reception of alarm information broadcast by the transmitter.

Still another object of the invention is to provide a pulse code transmitter for a floating alarm having means for altering a predetermined code.

Still another object of the invention is to provide an improved transmitter and receiver circuit arrangment for use with a buoyant alarm device which automatically interrupts broadcasting and sounding of an alarm after a predetermined interval of time.

In accordance with features of the invention, there is provided a circuit arrangment for a buoyant alarm device which indicates a disturbance to the quiescent level of a body of water. The alarm device is adapted to float in the body of water and includes first and second electrodes. The first electrode is supported above the water level and is adapted to contact the body of water when the device heels as a result of a disturbance to the quiescent water level. The second electrode is positioned in and maintained in contact with the body of water. A bistable electrical switching means is provided having a first nonconductive state and a second conductive state. A first circuit means causes the bistable switching means to switch from the first nonconductive state to the second conductive state when the first electrode contacts the body of water, and, initiates restoration of the bistable switching means to its first nonconductive state after a predetermined interval of time. A radio frequency transmitter is adapted to broadcast pulse encoded radio frequency signals upon the application of transmitter enabling pulses thereto. A pulse encoder means is coupled to the transmitter for generating a predetermined sequence of transmitter enabling electrical pulses when the bistable means exists in its second conductive state. The encoder means includes means for selectively varying the predetermined sequence of pulses. The transmitter and encoder are coupled to the bistable switching means and present an impedance thereto which inhibits flow of sustaining current in said bistable switch means when said first circuit means initiates restoration to the first nonconductive state.

BRIEF DESCRIPTION OF THE DRAWINGS

These and other objects and features of the invention will become apparent with reference to the following specification and to the drawings wherein.

DETAILED DESCRIPTION

Figure 1:
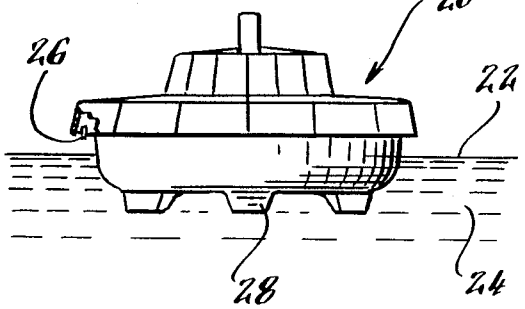
FIG. 1 is a diagram illustrating a buoyant device with which the circuit arrangment of the present invention is utilized.

Referring now to the drawings, there is illustrated in FIG. 1 a buoyant alarm device 20 which is adapted to indicate a disturbance to the quiescent level 22 of a body of water 24 in which the device is placed and floats. The device includes a first electrode 26 which is supported by the device 20 above the quiescent water level 22. A second electrode 28 depends from the device 20 and is positioned and maintained in electrical contact with the body of water 24. Upon the occurence of a disturbance to the quiescent level 22, a water wave, not shown, will cause the device to heel and the first electrode 26 will contact the body of water 24. The body of water 24 is conductive and an electrically conducting path is thereby established between the electrodes 26 and 28. The buoyant device 20 of FIG. 1 is disclosed in greater detail and is claimed in copending U.S. patent application Ser. No. 437,846 which is filed concurrently herewith and which is assigned to the assignee of this invention.

Figure 2:
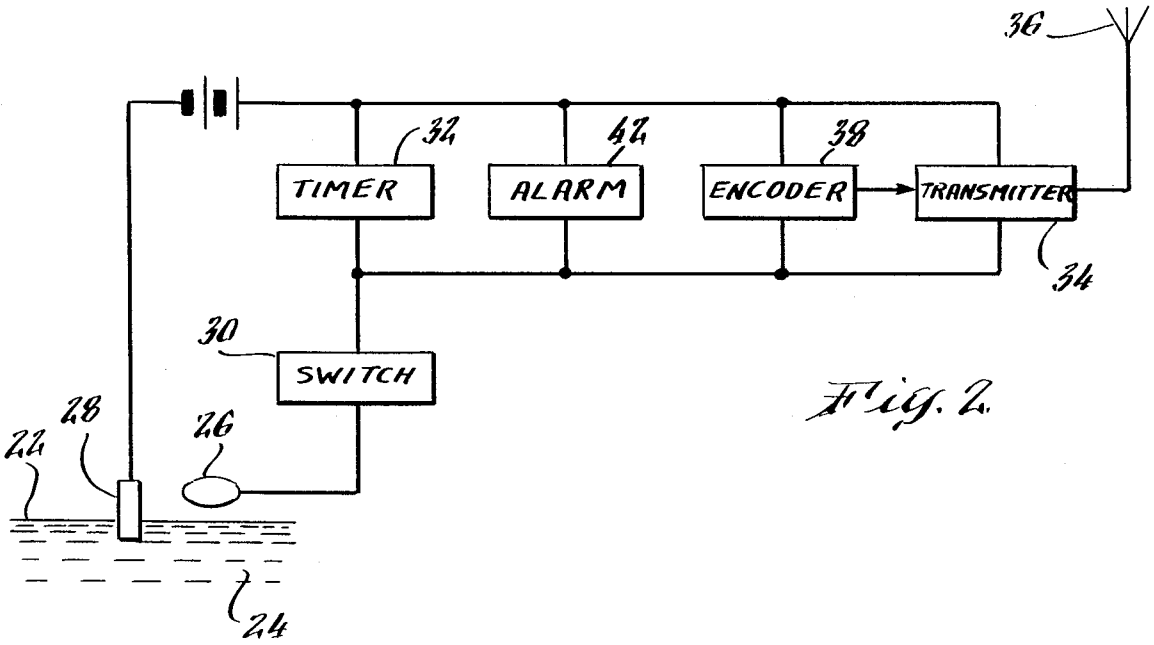
FIG. 2 is a diagram in block form of a sensing and transmitter circuit arrangment constructed in accordance with features of this invention.

The circuit arrangment of FIG. 2 includes a bistable electrical switching means 30 having a first nonconductive state and a second conductive state. A circuit means including a timer 32 is provided for causing the switching means 30 to switch from its first nonconductive to its second conductive state when a conductive path is established between the electrodes 26 and 28 as the electrode 26 contacts the body of water 24. The timer automatically initiates restoration of the switching means 30 to its first nonconductive state after a predetermined interval of time. A radio frequency transmitter 34 is provided and is coupled to a transmitting antenna 36 and to an encoding circuit means 38. The transmitter is adapted to broadcast pulse encoded radio frequency signals upon the application of enabling pulses thereto. The pulse encoding means which is coupled to the transmitter 34 generates a selectable, predetermined sequence of transmitter enabling pulse signals when the bistable device 30 is in its second conductive state. An audible alarm 42 is also provided and is positioned in the device 20 for sounding an audible alarm at the device when the switching means 30 exists in its second conductive state.

Figure 3:
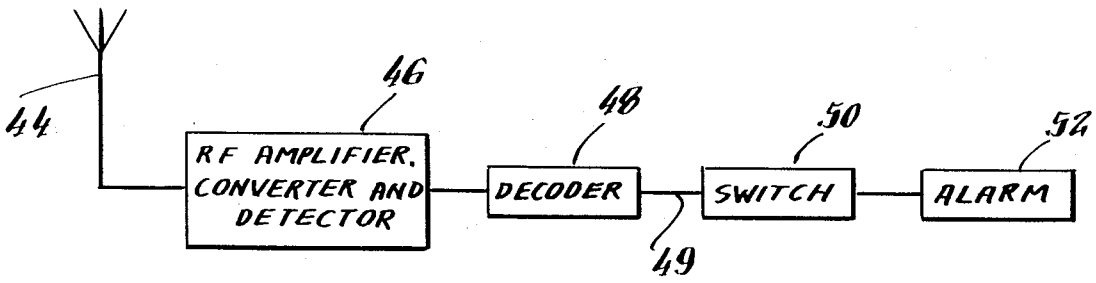
FIG. 3 is a diagram in block form of a receiver for use with the transmitter of FIG. 2.

A remotely located receiver and alarm arrangment shown in FIG. 3 is provided and operates in cooperation with the transmitter of FIG. 2. Pulsed radio frequency signals are induced in a receiving antenna 44 and are amplified and detected by an RF amplifier, converter and detector means 46. An output signal from the RF amplifier and detector means is coupled to a decoder 48 which operates to provide an output signal on output line 49 when the predetermined code broadcast by the transmitter 34 is received. The output signal of line 49 is applied to a switch 50 which actuates an audible alarm 52. The alarm 52 will be energized only for the interval of time during which the predetermined pulse encoded radio frequency signals are broadcast and received.

Figure 4:
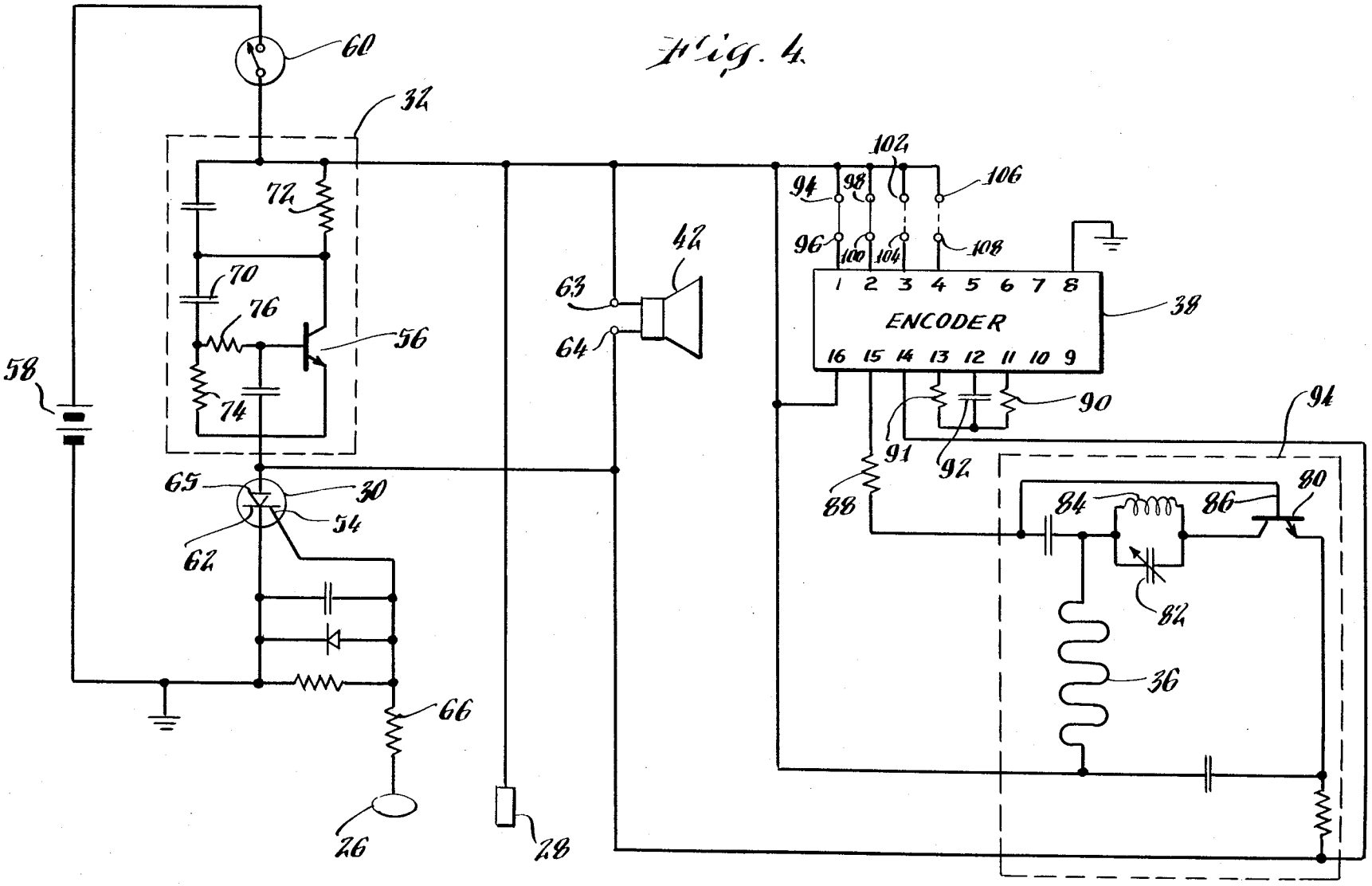
FIG. 4 is a schematic diagram of the circuit arrangment of FIG. 2.

In the schematic diagram of FIG. 4, the bistable means 30 is shown to comprise a silicon controlled rectifier having a gate electrode 54. The timer 32 of FIG. 2 is illustrated within the dashed rectangle and is referred to in FIG. 4 by the same reference numeral 32. Timer 32 includes a transistor 56. A positive terminal of a battery voltage source 58 is coupled to the timer circuit 32 by a manually actuated mercury tilt switch 60. A negative terminal of the battery source 58 is coupled to a cathode electrode 62 of the SCR 30. It will be observed that the anode-cathode circuit of SCR 30 is coupled in series for DC with the parallel coupled circuit comprising the timer 32, the alarm horn 42, the transmitter 34 and encoder 38. The horn 42 is of the electronic type and continuity between horn terminals 63 and 64 is intermittent when the horn is excited. One such horn suitable for use in the circuit of FIG. 4 is commercially available from the Mallory Corporation and is identified by Mallory No. SC 616NP.

Initially, SCR 30 and transistor 56 are non-conductive and a positive battery potential is applied to an anode electrode 65 of the SCR 30. Upon the occurrence of a disturbance in the pool water, a low impedance will be established between the electrodes 26 and 28. When this occurs, a positive voltage is applied through a resistor 66 to the gate electrode 54 thereby triggering SCR 30 into its second, conductive state. The transistor 56 now conducts. The potential at anode electrode 65 drops near ground potential and an operating potential is applied to the electronic horn 42 at its input terminals 63 and 64 which causes the horn to sound an audible alarm at the device. An operating potential is also applied to the encoder 38 and transmitter 34 causing the transmitter to broadcast, as described hereinafter, and causing an audible alarm at the remote station.

The circuit means 32 is adapted to initiate restoration of the SCR 30 to its first non-conductive state after a predetermined interval of time, T. This interval of time T is sufficiently long to provide for recognition of the broadcast controlled alarm and to alert a person at the remote station yet is relatively short to avoid depletion of the battery energy source. While various time intervals can be provided, a desired interval T is between about 4 to 6 minutes and preferably about 5 minutes. The SCR 30 will remain conductive until the current flowing in its anode-cathode circuit falls below sustaining level. Operating current flows to the SCR 30 through parallel current paths provided by the timer 32, the horn 42, the transmitter 34 and the encoder 38. However, the impedance of the transmitter and encoder are each relatively high and their parallel impedance are sufficient to restrict current flow therein to levels below the sustaining current level of the SCR 30. Since continuity through the horn 42 is periodically interrupted during horn energization, interruption of operating current to the SCR 30 will be initiated when the trigger circuit transistor 56 becomes nonconductive and continuity in the horn 42 is simultaneously interrupted. This occurs automatically after the interval T. When SCR 30 becomes conductive, a capacitor 70 coupled between the base and collector circuit of the transistor 56 begins to charge. After an interval of time, the capacitor 70 charges to a voltage level which causes the base-emitter current to interrupt the collector-emitter current of the transistor. Upon turn-off of transistor 56, current to the SCR 30 will decrease below its sustaining level on the next successive interruption of horn continuity and SCR 30 will switch to its first nonconductive state. The interval of time, T, during which the SCR 30 remains in its second conductive state is determined by the time constant of the capacitor 70 and the resistances 72, 74 and 76. The transistor 56 and the SCR 30 will remain conductive for an interval in the range of about 4 to 6 minutes, as indicated. During this interval, the horn 42 will sound and the transmitter and encoder will remain enabled as indicated hereinbefore.

The transmitter arrangment 34 of FIG. 4 includes an LCR oscilator circuit provided by an oscilator RF power output transistor 80, a variable capacitor 82, an inductor 84, and distributed reactances. This oscilator which operates at about 300 megahertz is coupled to the antenna 36. A base elctrode 86 of the transistor 80 is coupled to an output line 88 of the encoder 38. Transmitter enabling pulses are coupled from the encoder 38 to the base electrode over this line.

Figure 6:
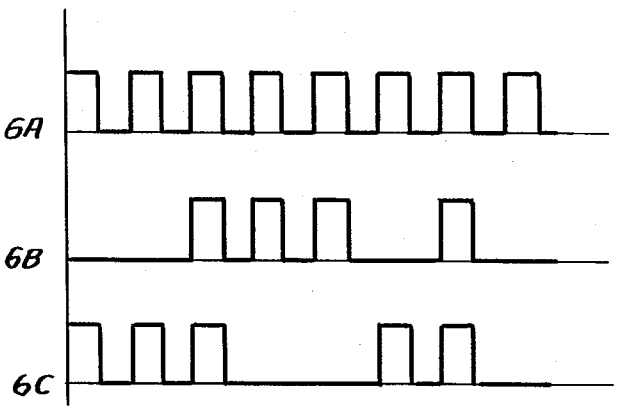

Encoder 38 which is adapted to generate a predetermined sequence of transmitter enabling pulses includes a means for varying the predetermined sequence. Encoder 38 comprises an integrated circuit which includes a pulse generator and various gating circuits for generating a repetitive pulse train of pulses. The means for varying the predetermined sequence enables a full train of pulses to be repetitively generated or various pulse combinations to be generated. An examplary pulse rate is about 2,000 pulses per second. The square wave pulses at this rate have a duration of about 2.5 ms. The pulse repetition rate is established by external resistors 90, 91 and capacitor 92 which are shown coupled between terminals 11, 12 and 13 of the encoder 38. FIGS. 6A, 6B and 6C illustrate several of the many different combinations of pulse train sequences which can be generated by the encoder 38. A particular sequence is established by the application of a DC potential to different input terminals of the encoder. Selection or adjustment of the pulse sequence is accomplished as illustrated in FIG. 4 by adding or removing jumper wires between external terminals 94-96, 98-100, 102-104, and 106-08. The different pulse trains of FIGS. 6A, 6B and 6C are exemplary of the combinations of pulse trains which can be generated by adding and removing jumpers as indicated. The selection of a predetermined pulse train for encoder 38 and the selection of a predetermined pulse train for decoder 48 at the remote location, as described hereinafter, provides for the broadcast of specifically encoded information which indicates a disturbance to the quiescent level of the pool water and which is substantially secure from interference by electrical noise and other services. The encoder 38 is a commercially available integrated circuit. The terminals illustrated within the rectangle of the encoder 38 are terminal reference numbers designated by the manufacturer. One such encoding device suitable for use with the circuit arrangment of FIG. 4 comprises a CMOS MSI remote control encoder which is commercially available from Motorola Semiconductor Products Inc. of Austin, Tex. It is identified by Motorola Part Number MC 145026 and is described in Motorola Technical Bulletin ADI-855. This encoder provides about 19,000 differing combinations of pulse codes. An output pulse train conforming with the predetermined code will occur on output line 88 and is coupled to the base electrode 86 of the transistor amplifier 80 for enabling the oscillator-amplifier. This oscillator-amplifier will then generate a sequence of pulses of radio frequency energy occurring in coincidence with the predetermined pulse code.

In order to preserve electrical energy and to extend the life of the battery source utilized with the circuit arrangment, it is desirable that the encoder 38 and the transmitter 34 become operative only when the SCR 30 is conductive. This is accomplished by coupling DC circuits of the encoder and transmitter in series with SCR 30 and in parallel with the timer circuit 32 and the horn 42. While it might appear that such a coupling would interfere with the restoration of the SCR 30 to is nonconductive state since a conductive circuit in series with the anode-cathode circuit of the SCR 30 will exist at all times, as indicated above, the impedances of the encoder and transmitter are each relatively high and restrict DC current flow therein to levels less than the sustaining current level of the SCR 30. Thus, when transistor 56 of the timer 32 initiates transistion of the SCR 30 from its conductive to is nonconductive state, current flow in the encoder 38 and transmitter 34 is interrupted and their operation terminates. In a particular exemplary arrangment, the SCR 30 comprises a Motorola Semiconductor Products 2N 5062 silicon controlled rectifier having a sustaining current of about 5 ma. Encoder 38 and transmitter 34 in combination draw a DC current of 2.5 ma.

Figure 5:
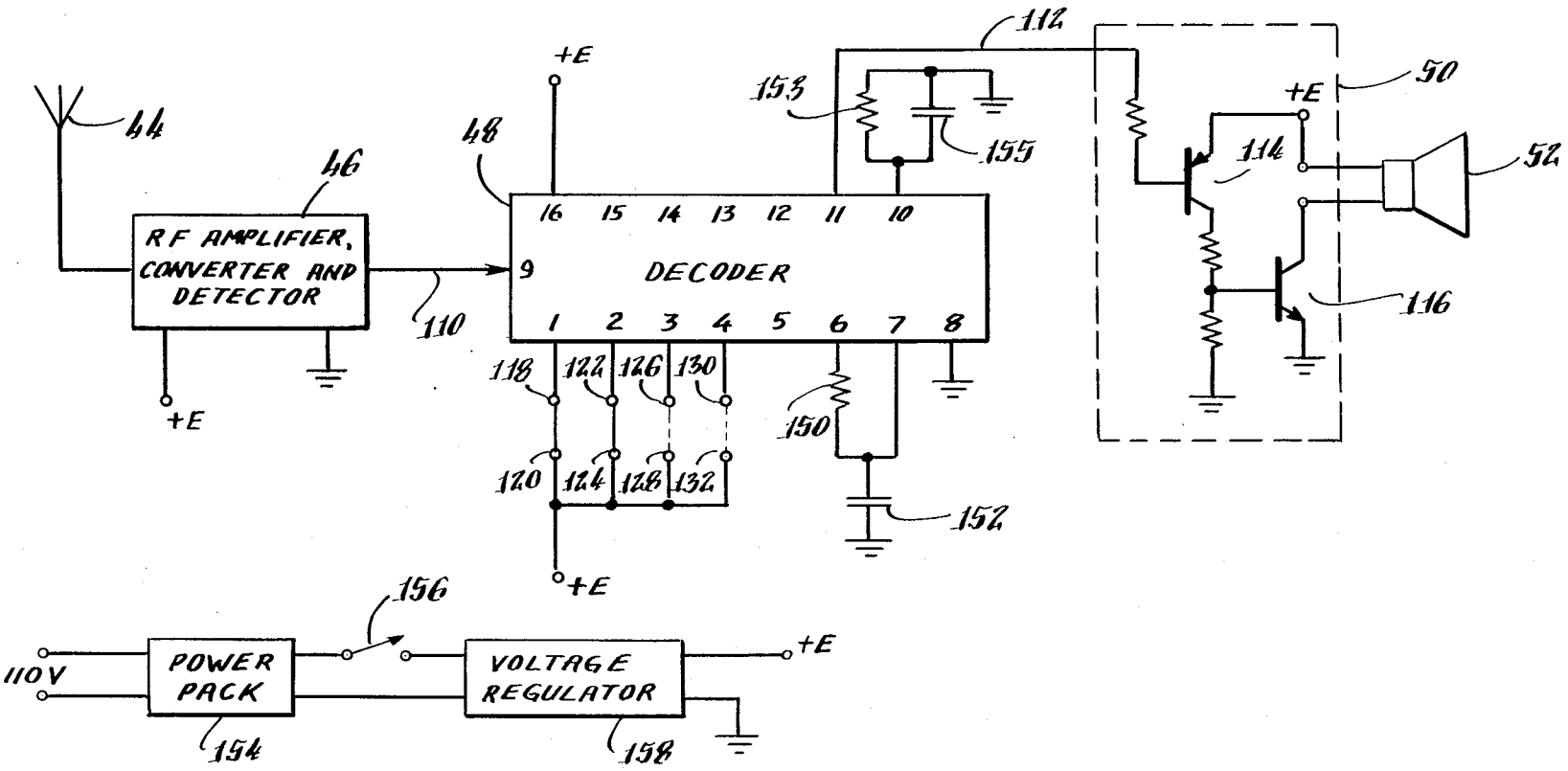
FIG. 5 is a schematic diagram, partly in block form, of the receiver circuit arrangment of FIG. 3; and, FIG. 6 is a diagram illustrating various wave forms of pulse sequences occurring in the circuit of FIG. 3.

FIG. 5 illustrates a receiving circuit arrangment utilized with the transmitter of FIG. 4. The pulse encoded radio frequency signals which are broadcast by transmitter 34 are induced in the receiving antenna 44 and are amplified and detected by a convential radio frequency amplifier, converter and detector 46. An output of the detector 46 is coupled to the decoder 48. Decoder 48 comprises an integrated circuit, pulse train generator and comparator. The pulse train generator is adapted to generate a pulse train corresponding to the pulse train generated by the encoder 38. The RF amplifier, converter and detector 46 will supply on an output line 110 thereof a pulsating DC voltage corresponding to the received pulses. These pulses along with the pulses locally generated by the decoder 48 are compared by the decoder for time coincidence. When the sequence of received and locally generated pulses correspond in time, an output voltage will occur on line 112 during coincidence. This output voltage is applied to electronic switch 50, shown to comprise transistors 114 and 116, which cause conduction therein and excitation of the horn alarm 52. As with the encoder 38, selection of the desired pulse code for decoder 48 is provided by use of jumpers at terminals 118-120, 122-124, 126-128 and 130-132. The decoder 48 is a commercially available integrated circuit. One such decoder suitable for use with the circuit arrangment of FIG. 5 comprises a CMOS MSI remote control decoder which is manufactured by Motorla Semiconductor Products Inc. of Austin, Tex. It is identified by Motorola part Number MC 145027 and is described in Motorola Technical Bulletin ADI-855.

Operating potential for the receiver is derived from a 110 volt line source and is applied to a power pack 154 which rectifies the line voltage and reduces its amplitude to about 9 volts DC. This DC voltage is applied through an on-off switch 156 to a voltage regulator 158. The regulated DC voltage is applied to the RF amplifier, converter and detector 46, the decoder 48, the electronic switch 50 and horn 52 as illustrated.

The circuit arrangment of FIG. 4 illustrates the alarm horn 42 positioned on and used at the device 20 in conjunction with the transmitter 34 and the encoder 38. This transmitter arrangment can alternatively be used without the alarm horn at the device 20 in which case only the remotely located horn 52 will sound upon occurrence of a disturbance An improved arrangment for use with a buoyant alarm device has thus been described. The circuit arrangment is advantageous in that a time limited broadcast of radio frequency transmissions to a remote station are substantially protected from interference with other service and from electrical noise through the use of a pulse encoding. The pulse code can be readily altered through the use of jumpers with external terminals. Depletion of an operating power source for the buoyant device is reduced by the use of a first circuit means which automatically initiates restoration of a bistable switching means to a first nonconductive state at the end of a predetermined interval of time thus interrupting the transmission. Broadcasting will occur for a time interval sufficiently long to permit recognition and response at a remote station. The transmitter and encoder draw relatively low current and are adapted and coupled to enable turn off of the bistable means.

While there has thus been described a particular embodiment of the invention, it will be apparent to those skilled in the art that variations may be made thereto without departing from the spirit of the invention and the scope of the appended claims.

What is claimed is:

1. A circuit arrangement for a buoyant alarm device which indicates a disturbance to the quiescent level of a body of water in which the device is placed, said device adapted to float in the body of water and having first and second electrodes, said first electrode adapted to contact the body of water when the device is caused to heel by a disturbance to the quiescent water level, said second electrode positioned in and maintained in contact with the body of water comprising:

a. a bistable electrical switching means having a first nonconductive state and a second conductive state;

b. a first circuit means for causing said bistable switching means to switch from said first nonconductive state to said second conductive state when said first electrode contacts said body of water, and, for automatically initiating restoration of said bistable switching means to said first nonconductive state after a predetermined interval of time, T;

c. a radio frequency transmitter adapted to continuously broadcast a sequence of pulse encoded radio frequency signals during the interval T upon the application of transmitter enabling pulses thereto; and d. a pulse encoder means coupled to said transmitter for generating and applying to said transmitter predetermined repetitive sequences of transmitter enabling electrical pulses during the interval T.

2. The circuit arrangment of claim 1 including means for varying the predetermined sequence of pulses generated by said encoder.

3. The circuit arrangment of claim 2 wherein said means for varying said sequence of pulses comprises terminal jumper means.

4. The circuit arrangement of claim 1 wherein said bistable electrical switching means comprises a silicon controlled rectifier.

5. The circuit arrangment of claim 4 wherein said first circuit means comprises a monostable trigger circuit.

6. The circuit arrangment of claim 5 wherein said first circuit means, said encoder and said transmitter are coupled in parallel; said silicon controlled rectifier is coupled in series with said parallel coupled first circuit means, said encoder and said transmitter; said silicon controlled rectifier has a sustaining current amplitude characteristic thereof; and said encoder and transmitter have impedances thereof which inhibits the flow of a sustaining current amplitude therein.

7. The device of claim 1 including a radio frequency receiver positioned at a remote location, said receiver including a pulse decoding means and an audible alarm means, said pulse decoding means adapted to enable said alarm means when said predetermined repetitive sequence of radio frequency pulses are received.

8. The device of claim 7 wherein said pulse decoding means provides a predetermined sequence of electrical pulses which occur coincidently in time with said encoder electrical pulses, and a comparator means for comparing said encoder and decoder pulses and for generating an alarm signal upon coincidence of said pulses.

9. The circuit arrangement of claim 1 including an audible alarm which is energized when said bistable switching means is conductive and is degenerized when said switching means is non-conductive.

10. The circuit arrangment of claim 6 including an alarm horn coupled in parallel with said first circuit means, said horn including a circuit which exhibits intermittent circuit continuity.

11. A circuit arrangement for a pool alarm device which indicates a disturbance to the quiescent level of pool water in which the device is placed, said device adapted to float in the pool and having first and second electrodes, said first electrode adapted to contact the pool water when the device is caused to heel by a disturbance to the quiescent water level, said second electrode positioned in and maintained in contact with the pool water comprising:

a. a silicon controlled rectifier having a sustaining current level below which level said rectifier becomes non-conductive;

b. said rectifier having a first nonconductive state and a second conductive state;

c. a first circuit means for causing said rectifier to switch from said first nonconductive state to said second conductive state when said first electrode contacts said pool water, and, for automatically initiating restoration of said rectifier to said first nonconductive state after a predetermined interval of time, T;

d. a radio frequency transmitter adapted to continuously broadcast a sequence of pulse encoded radio frequency signals during the interval T upon the application of transmitter enabling pulses thereto;

e. a pulse encoder means coupled to said transmitter for generating and applying to said transmitter predetermined repetitive sequences of transmitter enabling electrical pulses during the interval T;

f. said transmitter and said encoder coupled to said rectifier and having an operating current thereof which is less than said rectifier sustaining current flowing through said rectifier in said second conductive state whereby said operating current to said encoder and transmitter is interrupted when said rectifier is restored to said first nonconductive state.

* * * * *